US005934173A

United States Patent [19]

Murphy et al.

[11] Patent Number: 5,934,173

[45] Date of Patent: Aug. 10, 1999

[54] RECIPROCATING PLUNGER PUMP

[75] Inventors: Edward P. Murphy, Blaine; Frank L. Amyotte, St. Paul, both of Minn.

[73] Assignee: Hypro Corporation, St. Paul, Minn.

[21] Appl. No.: 08/909,015

[22] Filed: Aug. 8, 1997

[51] Int. Cl.[6] ..... F01B 31/00

[52] U.S. Cl. ..... 92/165 R; 74/579 E; 417/464; 417/489

[58] Field of Search ..... 92/187, 165 R; 74/579 E; 417/464, 489

[56] References Cited

U.S. PATENT DOCUMENTS

| | | | |
|---|---|---|---|
| 382,760 | 5/1888 | Erwin | 417/464 |
| 2,765,742 | 10/1956 | King | 417/464 |
| 3,802,805 | 4/1974 | Roeser | 417/489 X |
| 4,012,174 | 3/1977 | Seibel et al. | 417/489 X |
| 4,021,153 | 5/1977 | Cloup | 417/489 X |
| 4,530,646 | 7/1985 | McCoy | 417/464 |
| 5,144,882 | 9/1992 | Weissgerber | 417/489 X |

*Primary Examiner*—Hoang Nguyen

*Attorney, Agent, or Firm*—Nikolai, Mersereau & Dietz, P.A.

[57] ABSTRACT

An improved reciprocating plunger pump boasting a self-aligning plunger assembly, a selectively removable plunger guide cartridge, and an improved seal cartridge assembly.

3 Claims, 13 Drawing Sheets

RECIPROCATING PLUNGER PUMP

BACKGROUND OF THE INVENTION

I. Field of the Invention

The present invention relates generally to the field of reciprocating pumps. More particularly, the present invention relates to an improved reciprocating plunger pump boasting a self-aligning plunger assembly, a selectively removable plunger guide cartridge, and an improved seal cartridge assembly.

II. Discussion of the Prior Art

Plunger pumps may be characterized generally as including a plunger which reciprocates past a plurality of stationary seals so as to generate a pressurized fluid flow. FIG. 13 illustrates a plunger pump 10 typical of those employed in the prior art. The pump 10 includes a crankcase 12, a head assembly 14, and a reciprocating plunger assembly 16. The crankcase 12 includes an oil chamber 18, a plunger guide 20 for slidably receiving a plunger rod 22, and a drainage area 24 open to ambient. The head assembly 14 is two-piece in construction, including a first head member 26 and a second head member 28. Extending between the first head member 26 and the second head member 28 is a retainer 30 for forcibly maintaining a seal spreader 32 and a high pressure seal 34 within the second head member 28. The second head member 28 further includes a retaining slot for fixedly retaining a low pressure seal 36 therewithin. The plunger assembly 16 includes a reciprocating plunger 38 coupled to the plunger rod 22 via a retaining nut 40, and a connecting rod 44 extending between a rotatable crankshaft 42 and the plunger rod 22.

In order to prevent the migration of oil from the crankcase 12, a cartridge 46 is provided extending between the second head member 28 and the oil chamber 18 having an oil seal 48 for forming an oil-tight junction about the plunger guide 20 and a wiper member 50 for augmenting the sealing capability of the oil seal 48. In the event that oil does seep past the wiper member 50 and the oil seal 48, a plurality of weep holes 52 are formed in the cartridge 46 to allow any oil to drain out of the pump 10 by exiting through the drainage area 24. In order to prevent the unwanted migration of fluid from the head assembly 14, the seal spreader 32 is employed in conjunction with the high pressure seal 34 to form a fluid-tight junction with the plunger 38 which is capable of maintaining high fluid pressure within the head assembly 14. The low pressure seal 36 is also provided within the second head member 28 to maintain a low pressure fluid bath against the plunger 38 for the purpose of cooling the high pressure seal 34.

While generally effective, the pump 10 is nonetheless fraught with several formidable drawbacks. One of the more pronounced disadvantages relates to the construction of the plunger assembly 16. As is common in the prior art, the plunger rod 22 is coupled to the connecting rod 44 in a "press fit" fashion such that the plunger rod 22 is only capable of translating back and forth in a single plane. This "single plane" translation is problematic, however, in that the plunger rod 22 may be subject to side loading during operation due to any slight misalignment which may exist between the bores within the crankcase 12 and the head assembly 14. Such misalignment is not uncommon due, in part, to the multiplicity of components in the head assembly 14 which must be specifically co-aligned with the plunger guide 20 during the assembly process. The problem of side loading is particularly menacing in that it increases the degree of friction experienced by the seals within the head assembly 14 and crankcase 12, as well as the plunger rod 22 and plunger 38, due to the transverse forces exerted by the plunger rod 22 and plunger 38 during reciprocation. The increased friction elevates the temperature within the pump 10 which, in turn, disadvantageously causes the various seals to deteriorate prematurely and causes the plunger rod 22, the plunger 38, and the plunger guide 20 to experience accelerated wear and tear. From this stems increased costs for repair and/or replacement of the damaged components.

Another significant disadvantage stems from the fact that the plunger guide 20 is formed as a continguous portion of the crankcase 12. This is problematic in that the plunger guide 20 necessarily experiences abrasion due to the reciprocating action of the plunger rod 22 during pump operation. Over time, this abrasive activity will cause "scoring" wherein unwanted pits or grooves are formed in the plunger guide 20 and/or the plunger rod 22. The problem of "scoring" may manifest itself by causing oil to leak from the crankcase 12, as well as an overall reduction in pumping efficiency. To remedy this, the crankcase 12 must be replaced altogether. As will be appreciated, this requires a substantial amount of service time to dismantle all of the component parts from the crankcase 12 and reassemble them with a new crankcase 12. Crankcase replacement is also costly in that, as a relatively large part, the crankcase 12 consumes a large amount of material. Moreover, the plunger guide 20 must be specifically formed within the crankcase 12 and be machined in precise fashion to accept the plunger rod 22, thereby increasing the overall cost of manufacture. The plunger guide 20 also extends well into the interior of the crankcase 12 which, as will be appreciated, mandates that the plunger rod 22 is also of increased length to couple the connecting rod 44 to the plunger 38. Increasing the length of the plunger rod 22 excaserbates the problem of side loading which, as noted above, causes excess friction, high temperatures, seal deterioration, and "scoring" on the plunger rod 22 and the plunger guide 20.

Still other drawbacks with the prior art pump 10 relate to the seal arrangement. First and foremost, the pump 10 fails to provide the various seals in a readily accessible and conveniently removable fashion such that servicing operations, such as seal repair and/or replacement, are laborious and time consuming. For example, the low pressure seal 36 is disposed completely within the confines of the second head member 28, the seal spreader 32 and the high pressure seal 34 are force fit in between the retainer 30 and the second head member 28, and the oil seal 48 is disposed within the far end of the cartridge 46. In this arrangement, a serviceperson must thus remove the first head member 26, the retainer 30, the second head member 28, and the cartridge 46 to avail all of the sealing members for maintenance or replacement. This is particularly disadvantageous in that it is burdensome and time consuming to dismantle this host of pump parts every time the seals require servicing. The task of servicing is furthermore made difficult due to the fact that the low pressure seal 36 is effectively buried within the second head member 28 which, as will be appreciated, requires substantial effort to remove and replace the low pressure seal 36.

Another related drawback is that the sealing arrangement permits air to migrate from the drainage area 24 into the head assembly 14 during priming operations and negative pressure conditions at the fluid inlet 54. This stems from the fact that the low pressure seal 36 is incapable of forming an adequate seal about the plunger 38 during such conditions. To further explain, the low pressure seal 36 is a standard U-cup which forms a uni-directional seal along the plunger when properly energized or expanded. The necessary energization occurs when low pressure fluid is allowed to flow between the low pressure seal 36 and the high pressure seal 34 such that the U-cup expands inwardly and envelops the plunger 38 to form a seal therealong. While the low pressure seal 36 is effective in minimizing the degree to which low pressure fluid may seep into the drainage area 24 when properly energized, air will nonetheless flow inwardly past the low pressure seal 36 during priming operations due to the fact that there is little or no fluid pressure to adequately bias the low pressure seal 36 against the plunger 38. This increases the likelihood of producing an air-lock condition within the head assembly 14 which may inhibit or altogether thwart priming operations within the pump 10. Negative pressure conditions at the fluid inlet 54 may occur, for example, when the fluid reservoir supplying coupled to the fluid inlet 54 is disposed below the pump 10. Such negative pressure also acts upon the low pressure seal 36 in that the fluid inlet 54 is coupled to the channel defined between the high and low pressure seals 34, 36. Negative pressure at the low pressure seal 36, in turn, causes the low pressure seal 36 to lose its charge such that air may be drawn therepast into the fluid inlet 54 and ultimately into the head assembly 14. During operation, such an influx of air into the fluid inlet 54 may cause cavitation which, as will be appreciated, adversely affects the efficiency and life expectancy of the pump 10.

In view of the foregoing, a need exists for an improved plunger pump which overcomes the aforementioned deficiencies in the prior art.

OBJECTS AND SUMMARY OF THE INVENTION

Accordingly, it is a primary object of the present invention to produce an improved plunger pump which is leak-free, low maintenance, and easy and inexpensive to service.

It is a still further object of the present invention to provide an improved plunger assembly for use in a reciprocating plunger pump which is capable of self-aligning the plunger during operation to eliminate side loading, thereby minimizing wear and tear on the pump, prolonging the life of the pump, and minimizing overall expense.

It is still another object of the present invention to provide a selectively removable plunger guide cartridge in the crankcase for accepting all the wear and tear due to the reciprocating plunger rod, thereby eliminating the abrasion experienced by the crankcase.

It is yet another object of the present invention to provide an improved seal arrangement which maintains all of the seals within a unitary cartridge assembly which is readily accessible and easily extractable for facilitating servicing operations.

It is a still further object of the present invention to provide an improved sealing arrangement for a plunger pump which provides the ability to prevent air-lock conditions during priming operations and cavitation due to negative pressure conditions at the fluid inlet during normal operation.

In a first preferred embodiment of the present invention, the foregoing objects and are achieved by providing an improved plunger assembly for reciprocating pumps, comprising plunger rod means, connecting rod means, and coupling means. The plunger rod means has a first end, a second end disposed opposite the first end, and an aperture formed through the first end. The connecting rod means is provided for coupling the plunger rod means to a crankshaft. The connecting rod means includes a crankshaft aperture for receiving a cankshaft and plunger rod receiving means for receiving the first end of the plunger rod means loosely therebetween. The plunger rod means is provided for coupling the plunger rod means within the plunger rod receiving means such that the plunger rod means is capable of translating in at least two directions relative to the connecting rod means to automatically self-align during operation.

In accordance with yet another broad aspect of the present invention, an apparatus is provided for guiding a reciprocating member within a crankcase of a pump. The apparatus comprises guide cartridge means for placement within a bore formed in a crankcase of a pump. The guide cartridge includes a fluid seal dimensioned to receive the reciprocating member, and guide means for guiding the member during reciprocation.

In accordance with a still further broad aspect of the present invention, an improved seal carrying apparatus is provided for use in reciprocating plunger pumps. The seal carrying apparatus comprises seal cartridge means of unibody construction for placement within a bore formed in a crankcase. The seal cartridge has a concentrically disposed aperture for receiving reciprocating plunger means, a first internally disposed receiving area adjacent to the aperture, a second internally disposed receiving area adjacent to the aperture, and first and second channel means formed along an exterior of the seal cartridge means. A first low pressure seal is disposed within the first receiving area. A second low pressure seal is disposed within the second receiving area. An O-ring is also disposed within the second channel means for sealing off fluid around the periphery of the seal cartridge means. The seal cartridge means is capable of being quickly and easily removed from the bore to selectively replace one of the first low pressure seal, the second low pressure seal, and the O-ring.

In still another broad aspect of the present invention, an improved plunger pump is provided comprising a crankcase, a plunger assembly, and selectively removable guide means. The crankcase has a guide cartridge bore formed therein and a crankshaft disposed therein. The plunger assembly includes plunger rod means, connecting rod means, and coupling means. The plunger rod means has a first end, a second end disposed opposite the first end, and an aperture formed through the first end. The connecting rod means is provided for coupling the plunger rod means to a crankshaft. The connecting rod means includes a crankshaft aperture for receiving a crankshaft, and plunger rod receiving means for receiving the first end of the plunger rod means loosely therebetween. The plunger rod means is provided for coupling the plunger rod means within the plunger rod receiving means such that the plunger rod means is capable of translating in at least two directions relative to the connecting rod means to automatically self-align during operation. The selectively removable guide means have fluid seal means for the reciprocating plunger rod and a pair of guide members for guiding the plunger rod during reciprocation.

These and further objects and advantages of the present invention will be readily apparent to those skilled in the art from a review of the following detailed description of the preferred embodiment in conjunction with the accompanying drawings.

DETAILED DESCRIPTION OF THE PREFERRED EMBODIMENTS

Figure 1:
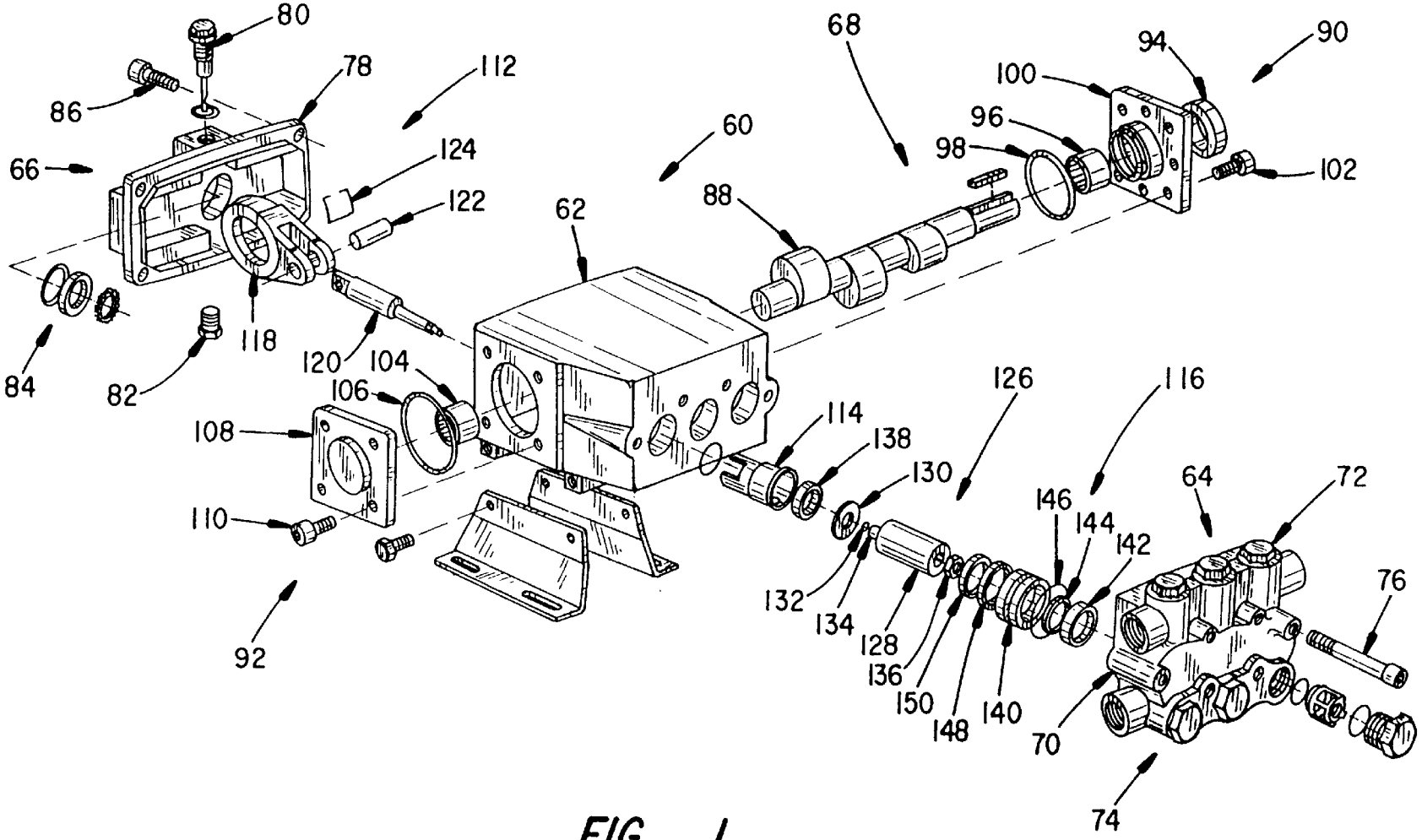
FIG. 1 is an exploded perspective view of a plunger pump 60 incorporating an improved plunger assembly 112, a guide cartridge 114, and an improved seal cartridge assembly 116 in accordance with a preferred embodiment of the present invention.

Referring initially to FIG. 1, shown in exploded perspective is a reciprocating plunger pump 60 provided in accordance with a preferred embodiment of the present invention. By way of example and not limitation, the pump 60 is a three cylinder reciprocating plunger pump with only the components associated with a single cylinder shown for clarity. The pump 60 includes a crankcase 62, a head assembly 64, a rear cover assembly 66, and a crankshaft assembly 68. The head assembly 64 includes a head block 70, a plurality of outlet valves 72, a plurality of inlet valves 74, and may be affixed to the crankcase 62 via a plurality of bolts, such as at 76. The rear cover assembly 66 includes a rear cover 78, a dipstick 80, an oil plug 82, a sight glass assembly 84, and may be affixed to the crankcase 62 via a plurality of bolts, such as at 86. The crankshaft assembly 68 includes a crankshaft 88, a first end cover assembly 90, and a second end cover assembly 92. The first end cover assembly 90 includes a crankshaft seal 94, a roller bearing 96, an O-ring 98, and a first end cover 100 capable of being affixed to the crankcase 62 via a plurality of bolts, such as at 102. The second end cover assembly 92 includes a roller bearing 104, an O-ring 106, and a second end cover 108 capable of being affixed to the crankcase 62 via a plurality of bolts, such as at 110.

In an important aspect of the present invention, the plunger pump 60 includes an improved plunger assembly 112 capable of self-aligning within the crankcase 62 and head block 70 during pump operation, a plunger guide cartridge 114 which accepts all of the wear and tear of the reciprocating plunger rod during pump operation, and an improved seal cartridge assembly 116 which facilitates seal replacement with minimal labor and time investment. The improved plunger assembly 112 comprises a connecting rod 118, a plunger rod 120, a connecting pin 122, and a retaining spring 124. The plunger rod 120 is coupled to the connecting rod 118 via the connecting pin 122. The retaining spring 124 is hingedly coupled to the connecting rod 118 and may be selectively positioned to retain the connecting pin 122 within the connecting rod 118 so as to maintain the coupled relation between the plunger rod 120 and the connecting rod 118. A plunger kit 126 is provided for use with the improved plunger assembly 112, including a ceramic plunger 128, a slinger ring 130, a backup seal 132, a washer 134, and a nut 136, all of which are positioned over the plunger rod 120. The plunger guide cartridge 114 is inserted within a bore formed in the crankcase 62 and includes an oil seal 138 disposed therein for sealing the oil within the crankcase 62. The seal cartridge assembly 116 includes a seal cartridge 140, a first high pressure seal 142, a second high pressure seal 144, an O-ring 146, a first low pressure seal 148, and a second low pressure seal 150.

Figure 2A:
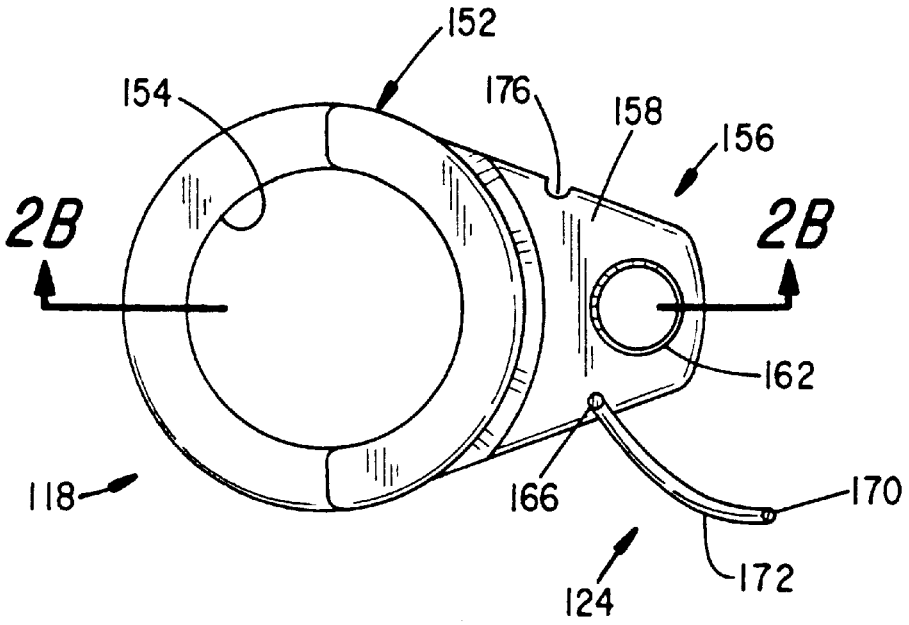
FIG. 2A is a top elevational view of a connecting rod 118 of the improved plunger assembly 112 of the present invention.
Figure 2B:
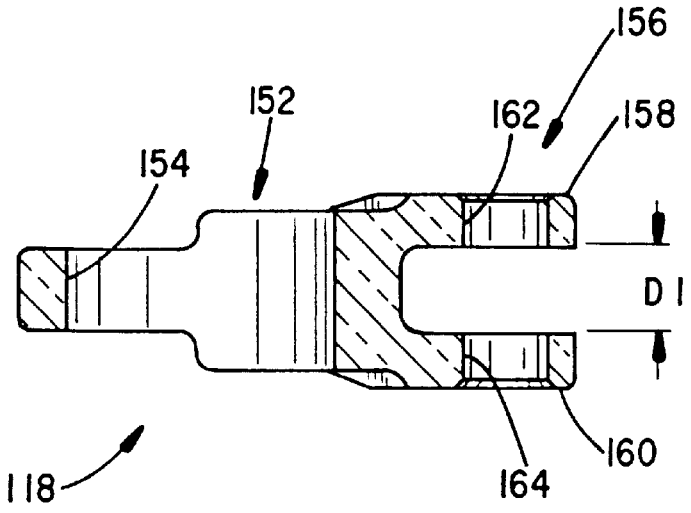
FIG. 2B is a cross-sectional view of the connecting rod 118 taken along lines 2B—2B in FIG. 2A.
Figure 3:
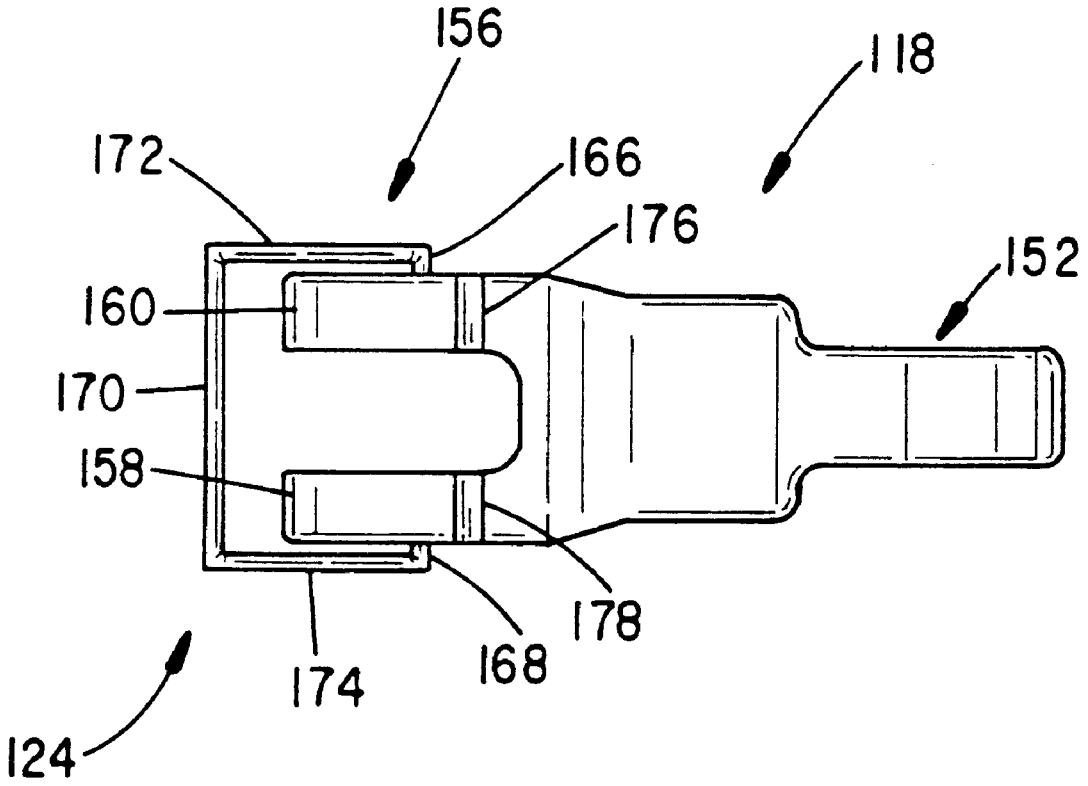
FIG. 3 is a side profile view of the connecting rod 118 shown in FIG. 2A.

Referring to FIGS. 2A–5B, the improved plunger assembly 112 of the present invention will now be described as follows. With reference first to FIGS. 2A–3, the connecting rod 118 includes a crankshaft coupling portion 152 having a generally cylindrical aperture 154 formed therein for receiving the crankshaft 88 of the pump 60. A plunger rod coupling portion 156 is furthermore provided comprising a pair of parallelly disposed buttress members 158, 160 extending from one side of the crankshaft coupling portion 152. The buttress members 158, 160 are specifically configured with a predetermined distance D1 between the opposing surfaces thereof The buttress members 158, 160 include generally cylindrical apertures 162, 164 formed therein which are co-aligned and dimensioned to receive the connecting pin 122 shown in FIG. 1. As will be set forth in greater detail below, one end of the plunger rod 120 is dimensioned to be received within the buttress members 158, 160 and is equipped with an aperture which is approximately equivalent in diameter to the cylindrical apertures 162, 164. The aperture of the plunger rod 120 may therefore be co-aligned in between the cylindrical apertures 162, 164 of the buttress members 158, 160 such that the connecting pin 122 may be inserted therethrough to thereby couple the plunger rod 120 to the connecting rod 118.

The retaining spring 124 is provided to selectively retain the connecting pin 122 while disposed in this engaged position. The retaining spring 124 includes first and second terminal ends 166, 168 disposed within appropriately sized apertures (not shown) formed in the buttress members 158, 160, a locking member 170, and first and second retaining members 172, 174 extending between the locking member 170 and the first and second terminal ends 166, 168, respectively. The retaining spring 124 is hingedly coupled to the connecting rod 118 via the first and second terminal ends 166, 168 such that the locking member 170 may be selectively engaged within first and second locking channels 176, 178 formed in the buttress members 158, 160, respectively.

When disposed as such, the first and second retaining members 172, 174 effectively obstruct the opposing ends of the connecting pin 122 such that it cannot be removed from its position within the cylindrical apertures 162, 164 of the buttress members 158, 160.

Figure 4A:
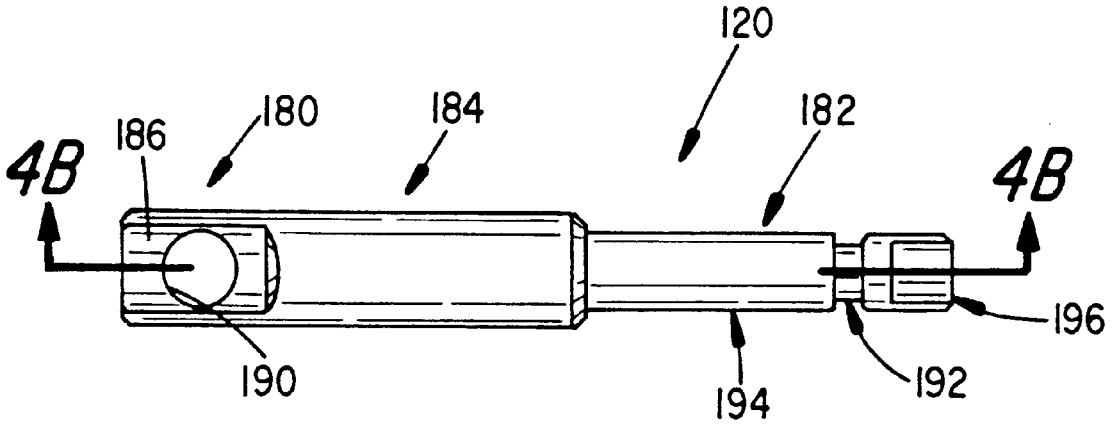
FIG. 4A is a top elevational view of a plunger rod 120 of the improved plunger assembly 112 of the present invention.
Figure 4B:
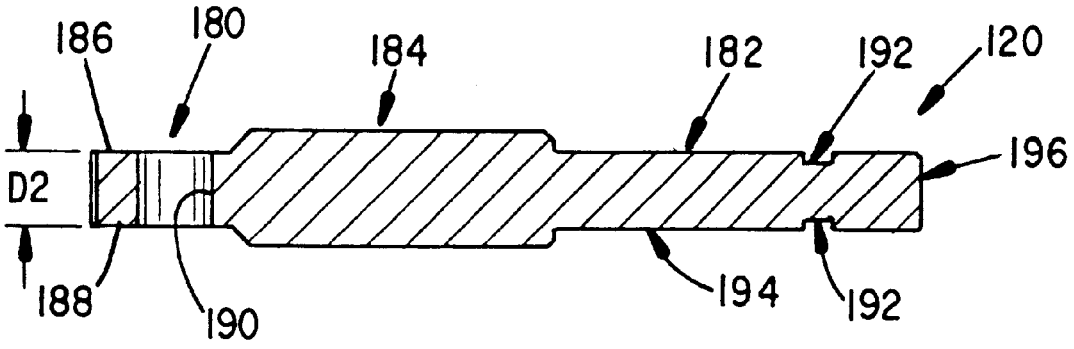
FIG. 4B is a cross-sectional view of the plunger rod 120 taken along lines 4B—4B in FIG. 4A.

With reference to FIGS. 4A and 4B, the plunger rod 120 includes a first coupling portion 180, a second coupling portion 182, and an engagement portion 184. The first coupling portion 180 is generally flat having a first planar surface 186, a second planar surface 188 disposed a predetermined distance D2 opposite the first planar surface 186, and a generally cylindrical aperture 190 extending perpendicularly therebetween for receiving the connecting pin 122 shown in FIG. 1. The second coupling portion 182 is generally cylindrical and includes a notch section 192, an elongated section 194, and a threaded section 196 extending distally from the notch 192. The notch section 192 is configured to receive the back-up seal 132 and the O-ring 134 shown in FIG. 1. The elongate section 194 is dimensioned to receive the plunger 128 shown in FIG. 1. The threaded section 196 is dimensioned to receive the nut 136 set forth in FIG. 1 to thereby secure the plunger 128 in between the engagement portion 184 and the nut 136. The engagement portion 184 is generally cylindrical and specifically dimensioned to engage with the oil seal 138 within the plunger guide cartridge 114 shown in FIG. 1. In an important aspect, the plunger rod 120 may be constructed from any of a variety of alloys having bearing characteristics. For example, in a preferred embodiment, the plunger rod 120 is a bearing-type alloy which is somewhat harder (i.e. 200 B-scale durability) than that found in the plunger guide cartridge 114 (i.e. 100 B-scale durability). As will be explained below, constructing the plunger rod 120 and the plunger guide cartridge 114 in this fashion is beneficial in that plunger guide cartridge 114 serves to polish the engagement portion 184 of the plunger rod 120 during the reciprocating action such that the plunger rod 120 does not experience scoring or pitting over time.

In an important aspect of the present invention, the first coupling portion 180 of the plunger rod 120 is configured such that the predetermined distance D2 is slightly smaller than the predetermined distance D1 existing between the opposing surfaces of the buttress members 158, 160. Dimensioning the first coupling portion 180 and the buttress members 158, 160 in this fashion allows the first coupling portion 180 to slide in between the buttress members 158, 160 for the purposes of securing the plunger rod 120 to the connecting rod 118. More importantly, as will be set forth below, this permits the plunger rod 120 to move laterally back and forth between the buttress members 158, 160 along the connecting pin 122 such that the plunger rod 120 automatically self-aligns itself within the crankcase 62 during operation. This is a critical improvement over the prior art in that the self-alignment of the plunger rod 120 within the crankcase 62 effectively combats any misalignment which may exist between the head assembly 64 and the crankcase 62 due to the assembly and/or manufacturing process. One of the more pronounced benefits of this self-alignment feature is that it minimizes the degree to which side loading is experienced by the plunger rod 120. A reduction in side loading effectively minimizes the overall amount of friction between the reciprocating parts, lowers the operating temperature, and minimizes seal deterioration and "scoring" on the plunger rod 22 and the plunger guide 20.

Figure 5A:
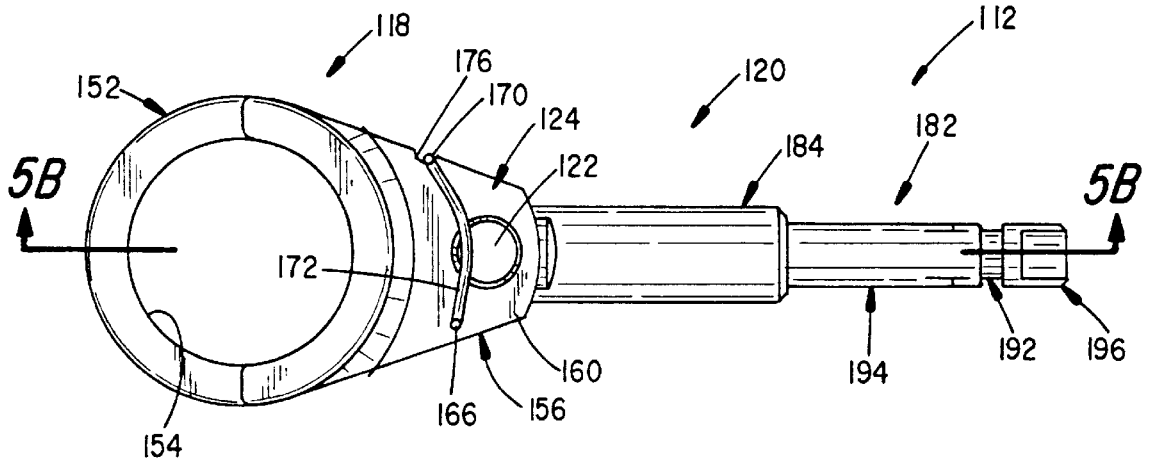
FIG. 5A is a top elevational view of the improved plunger assembly 112 in accordance with a preferred embodiment of the present invention.
Figure 5B:
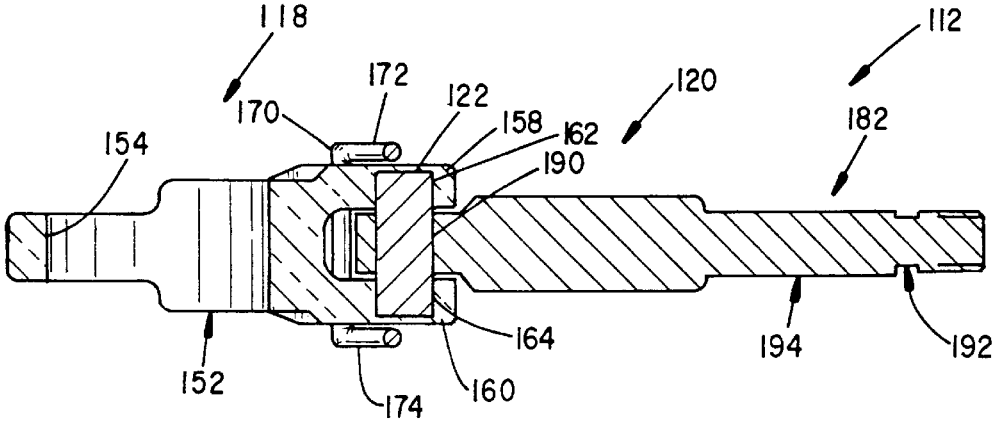
FIG. 5B is a cross-sectional view of the improved plunger assembly 112 taken along lines 5B—5B in FIG. 5A.
Figure 6A:
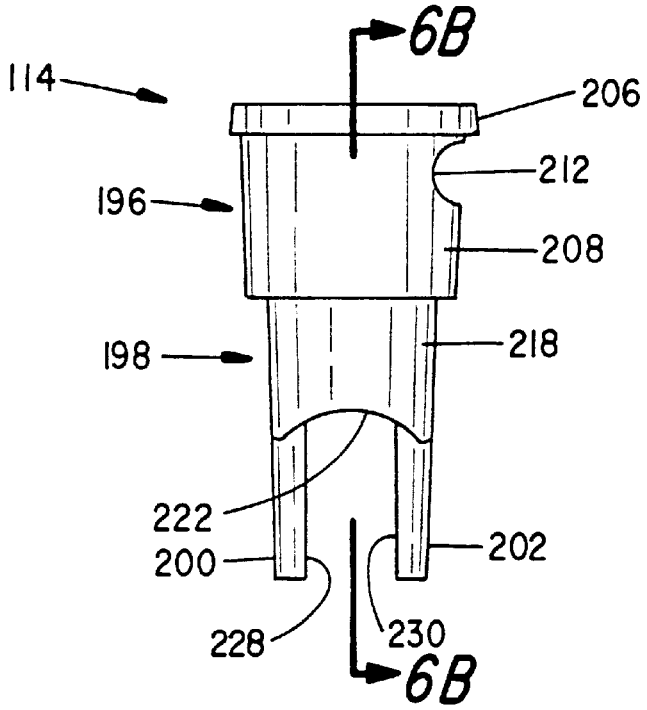
FIG. 6A is a side profile view of a plunger guide cartridge 114 of the present invention.
Figure 6B:
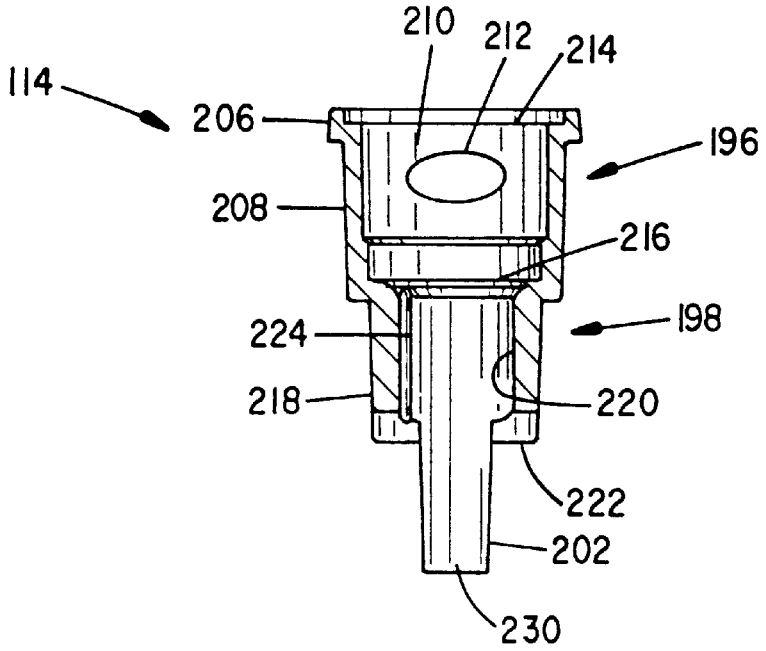
FIG. 6B is a cross-sectional view of the guide cartridge 114 taken along lines 6B—6B in FIG. 6A.
Figure 7A:
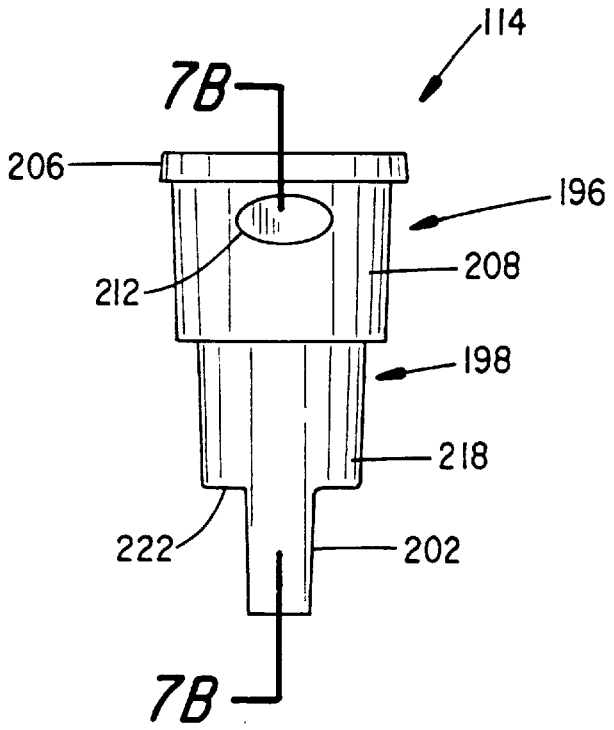
FIG. 7A is a front profile view of the guide cartridge 114.
Figure 7B:
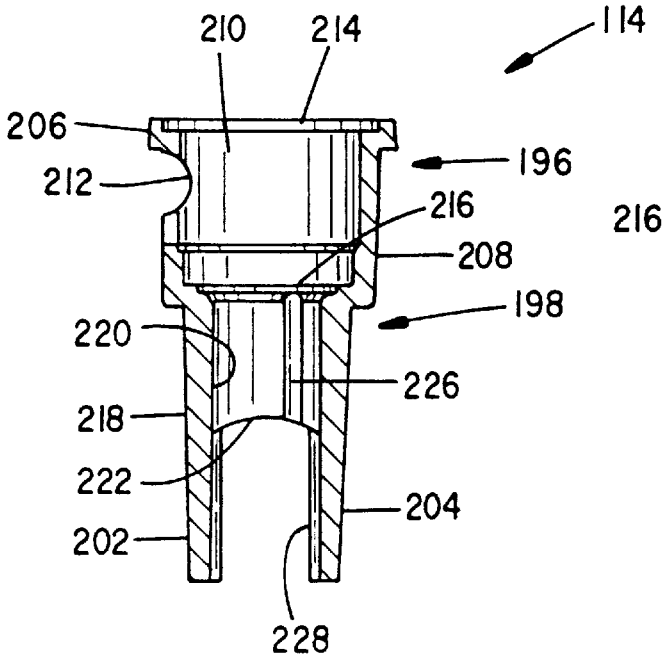
FIG. 7B is a cross-sectional view of the guide cartridge 114 taken along lines 7B—7B in FIG. 7A.
Figure 8:
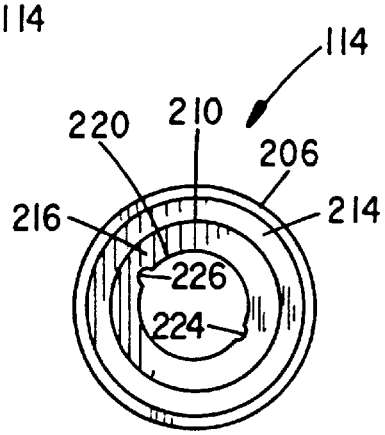
FIG. 8 is a top elevational view of the guide cartridge 114.

FIGS. 5A and 5B illustrate the improved plunger assembly 112 of the present invention in fully assembled form. The plunger rod 120 is coupled to the connecting rod 118 via the connecting pin 122 and the retaining spring 124. More specifically, the connecting rod 118 is disposed within the co-aligned apertures 190, 162, 164 of the plunger rod 120, the buttress member 158, and the buttress member 160, respectively. In order to accomplish this, the plunger rod 120 must be rotated clockwise with the retaining spring 124 in an open position, i.e. with the locking member 170 positioned proximate to the plunger rod 120. As noted above, with the connecting pin 122 inserted within the co-aligned apertures 190, 162, 164 of the plunger rod 120, the buttress member 158, and the buttress member 160, respectively, the retaining spring 124 may be rotated counter-clockwise until the locking member 170 engages within the locking channels 176, 178. With reference to FIG. 5A, the plunger rod 120 and connecting rod 118 are thereafter hingedly coupled together about the connecting pin 122 such that plunger rod 120 is capable of translating back and forth in the horizontal plane while the connecting rod 118 rotates within the crankcase 62 under the power of the rotating crankshaft 88. With reference to FIG. 5B, the first coupling portion 180 of the plunger rod 120 once again fits relatively loosely between the buttress members 158, 160 such that the plunger rod 120 may translate back and forth laterally along the connecting pin 122, thereby allowing the plunger rod 120 to automatically self-align itself within the crankcase 62.

In order to remove the plunger rod 120 from coupled relation with the connecting rod 118, the locking member 170 of the retaining spring 124 must be dislodged from the locking channels 176, 178 of the buttress members 158, 160, respectively. With the locking member 170 dislodged, the retaining spring 124 may thereafter be hingedly rotated clockwise out of position until the first and second retaining members 172, 174 are clear of the opposing end surfaces of the connecting pin 122. The connecting pin 122 may then be removed from the aperture 190 of the plunger rod 120 and the apertures 162, 164 of the buttress members 158, 160, respectively, such that the plunger rod 120 is no longer coupled to the connecting rod 118.

Referring now to FIGS. 6A–8, the plunger guide cartridge 114 of the present invention will now be described in detail. The plunger guide cartridge 114 is unibody in construction and includes a generally cylindrical upper portion 196, a generally cylindrical lower portion 198, and a pair of guide arms 200, 202 extending in generally parallel fashion from the lower portion 198. The upper portion 196 includes an annular lip member 206, an outer surface 208, and inner surface 210, and a drainage aperture 212 extending between the outer and inner surfaces 208, 210. The upper portion 196 is dimensioned to be received at least partially within a bore formed in the crankcase 62. The inner surface 210 includes an upper notch 214 dimensioned to receive the bottom of the seal cartridge 140 shown in FIG. 1, and a lower notch 216 dimensioned to receive the oil seal 138 shown in FIG. 1 via any number of known press-fit techniques. The oil seal 138 is specifically dimensioned to tightly envelope the engagement portion 184 of the plunger rod 120 such that no oil will escape from the crankcase 62 during the reciprocating movement of the plunger rod 120. The drainage aperture 212 cooperates with a drain area formed in the crankcase 62 to allow any fluid and/or oil which leaks past the high pressure seals 142, 144 and low pressure seals 148, 150 to flow out to atmosphere. This effectively isolates the oil within the crankcase 62 from the fluid within the head block 70 so as to minimize the potential of pump damage due to commingling.

The lower portion 198 of the plunger guide cartridge 114 includes an outer surface 218, an inner surface 220, and a bottom edge 222. The outer surface 218 is dimensioned to be received at least partially within a bore formed in the crankcase 62. The inner surface 220 is dimensioned to receive the engagement portion 184 of the plunger rod 120 and includes a first oil return channel 224 and a second oil return channel 226 which both start at the lower notch 216 of the upper portion 196 and extend to the bottom edge 222 of the lower portion 198. The first and second oil return channels 224, 226 provide a means by which to re-route oil from the vicinity of the oil seal 138 back into the crankcase 62, thereby avoiding overpressure conditions at the oil seal 138 during plunger rod 120 reciprocation. As with the lower portion, the guide arms 200, 202 similarly have inner surfaces 228, 230, respectively, which are dimensioned to receive and guide the engagement portion 184 of the plunger rod 120 during the reciprocation process. Importantly, the plunger guide cartridge 114 may be constructed from bearing-type alloy which is somewhat softer (i.e. 100 B-scale durability) than that found in the plunger rod 120 (i.e. 200 B-scale durability). Constructing the plunger rod 120 and the plunger guide cartridge 114 in this fashion is beneficial in that plunger guide cartridge 114 serves to polish the engagement portion 184 of the plunger rod 120 during the reciprocating action such that the plunger rod 120 and plunger guide cartridge 114 are less likely to experience scoring or pitting.

Figure 9:
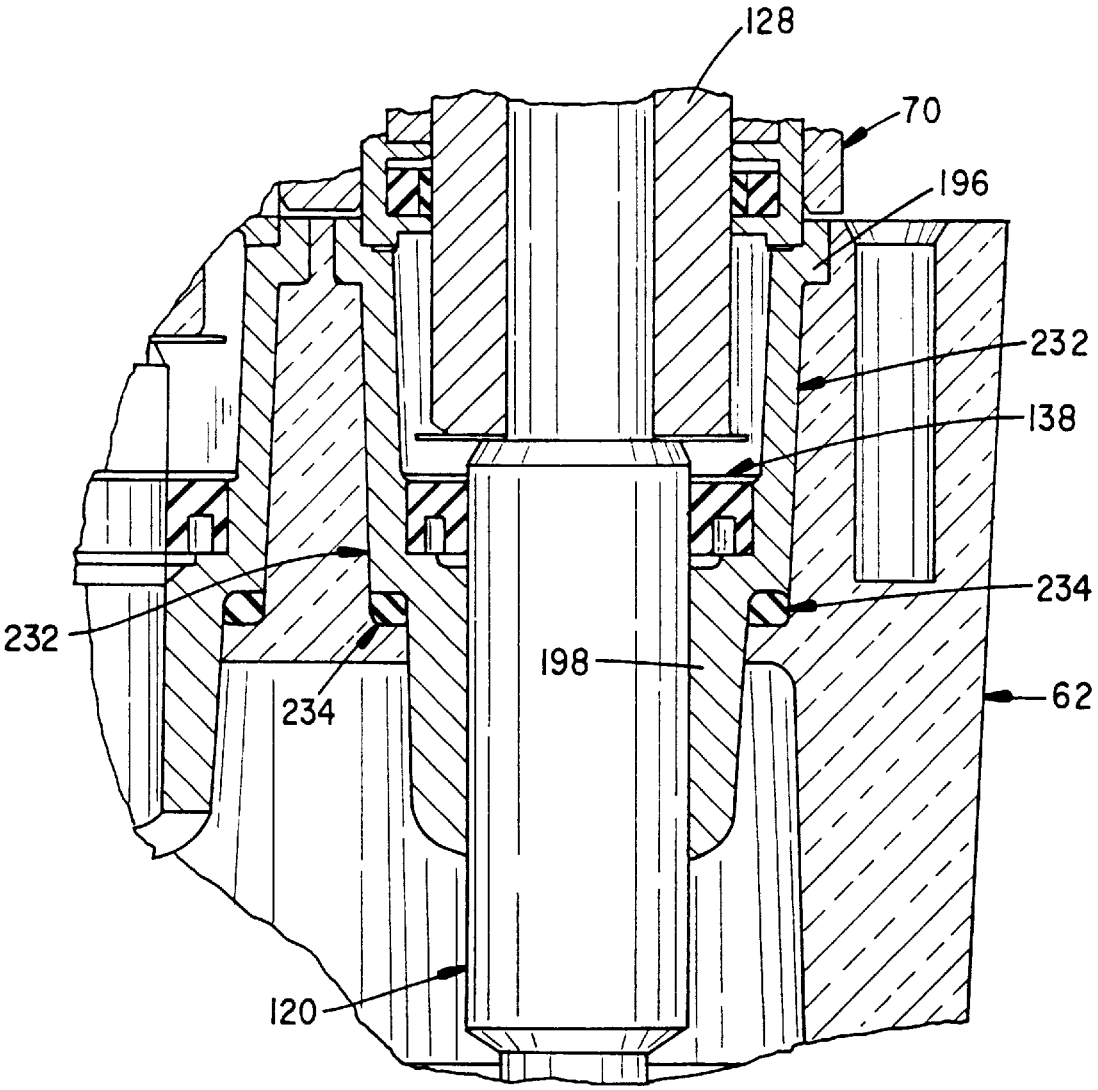
FIG. 9 is an enlarged partial sectional view further detailing the construction and placement of the guide cartridge 114 of the present invention within the crankcase 62.

With regard to FIG. 9, the plunger guide cartridge 114 forms an important part of the present invention in that it is situated within a bore 232 formed in the crankcase 62 for the purpose of accepting the bulk of all friction and wear due to the reciprocation of the plunger rod 120. More specifically, the plunger guide cartridge 114 is disposed within the bore 232 such that the upper portion 196 is secured generally within the crankcase 62 itself, while the guide arms 200, 202 extend at least partially into the oil chamber within the crankcase 62. An O-ring 234 is provided in between the plunger guide cartridge 114 and the crankcase 62 as further assurance against oil leakage along the outer periphery of the plunger guide cartridge 114. The oil seal 138 within the upper portion 196 serves to prevent the migration of oil along the inner periphery of the plunger guide cartridge 114. The oil seal 138 may comprise any number of commercially available oil seals and is provided to prevent the leakage of oil from the oil chamber of the crankcase 62 into the drain area (not shown). In a preferred embodiment, however, the oil seal 138 includes an outer plastic portion having a generally square cross section which encompasses an internally disposed garter spring to resiliently bias the plastic portion against the plunger guide cartridge 114, thereby preventing the influx of oil from the crankcase 62.

Figure 13:
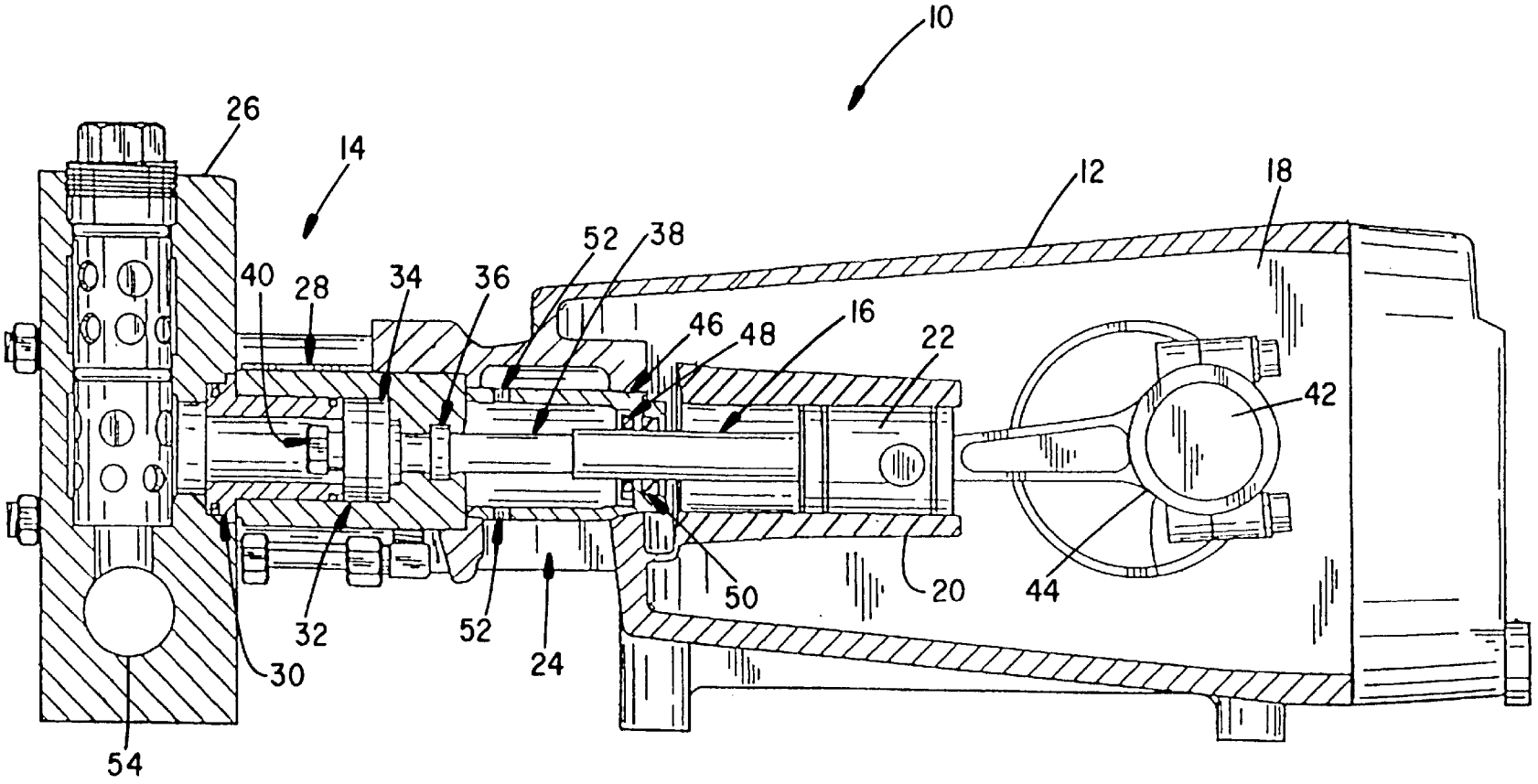
FIG. 13 (PRIOR ART)
FIG. 13 is a partial sectional side profile of a plunger pump 10 of the prior art.

The plunger guide cartridge 114 of the present invention presents a significant advantage in terms of ease of servicing the plunger pump 60. This is due to the fact that the plunger guide cartridge 114 simply resides within the bore 232 formed in the crankcase 62 such that only the head assembly 64 need be removed to access, remove, and replace the plunger guide cartridge 114. Advantageously, the plunger guide cartridge 114 accepts the wear and tear such that the crankcase 62 will not experience deterioration and, thus, will not ever require changing. It will be appreciated that the plunger guide cartridge 114 presents substantial cost savings, both in terms of the reduced time and labor required to change the plunger guide cartridge 114, as opposed to replacing the entire crankcase 62, as well as reduced outlay in terms the materials used to effectively service the pump 60. This is in contradistinction to the prior art plunger pumps, such as shown in FIG. 13, wherein the plunger rod 22 reciprocates directly within and against a guide 20 formed as part of the crankcase 12 and which, consequently, require replacing the entire crankcase 12.

Figure 10A:
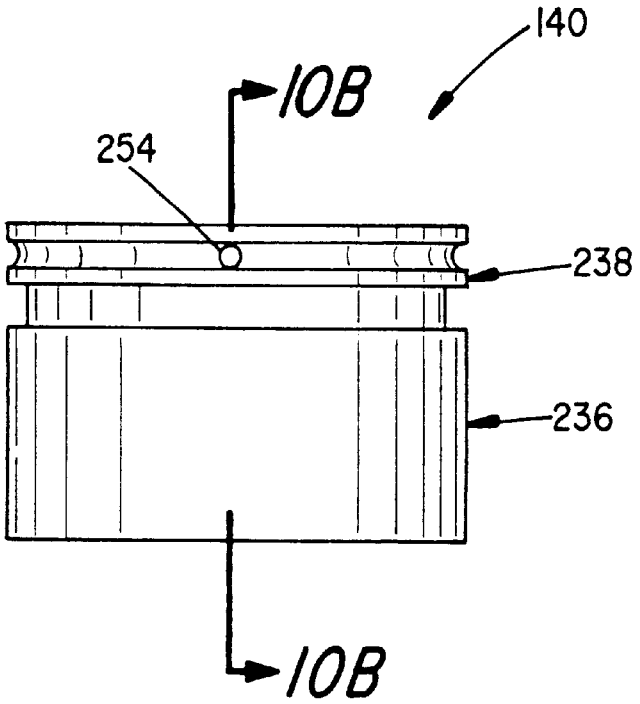
FIG. 10A is a side profile view of an improved seal cartridge 140 of the present invention.
Figure 10B:
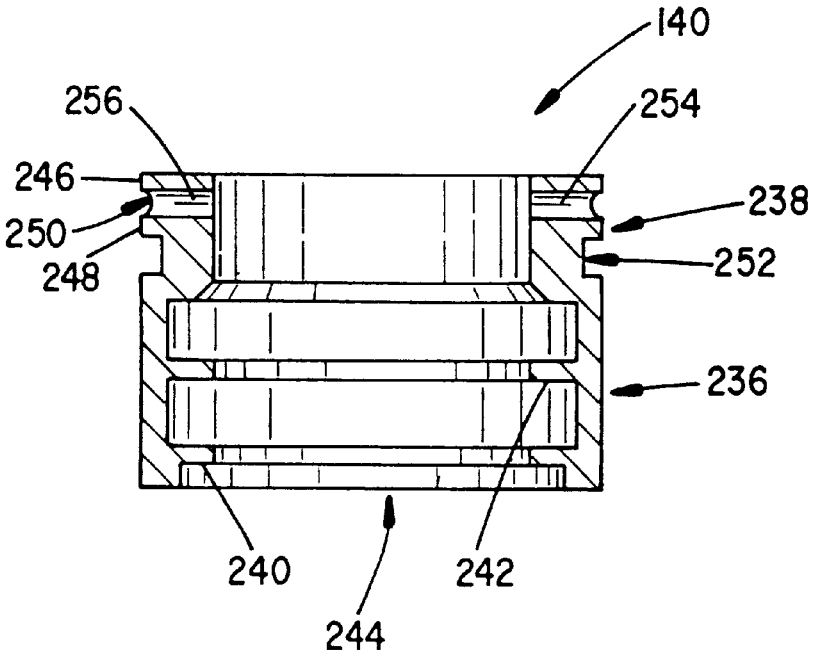
FIG. 10B is a cross-sectional view of the improved seal cartridge 140 taken along lines 10B—10B in FIG. 10A.

With further reference to FIGS. 10A and 10B, shown in detail is the seal cartridge 140 of the improved sealing cartridge assembly 116 of the present invention. The seal cartridge 140 is unibody in construction and includes a main body portion 236 and an upper body portion 238. The main body portion 236 interior includes a lower lip member 240, an upper lip member 242, and an aperture 244. The upper body portion 238 includes an upper lip member 246, a lower lip member 248, an upper groove 250 formed between the upper and lower lip members 246, 248, and a lower groove 252 formed between the lower lip member 248 and the main body portion 236. The upper groove 250 formed in the upper body portion 238 includes a plurality of flow apertures 254, 256 which provide a low pressure fluid bath for cooling the first high pressure seal 142 during operation. The lower groove 252 formed in the upper body portion 238 is dimensioned to receive the O-ring 146 to prevent migration of the low pressure fluid bath along the periphery of the seal cartridge 140. The space defined between the upper lip member 242 and the upper body portion 238 is dimensioned to receive the first low pressure seal 148 shown in FIG. 1. The space defined between the lower lip member 240 and the upper lip member 242 within the main body portion 236 is dimensioned to receive the second low pressure seal 150.

Figure 11:
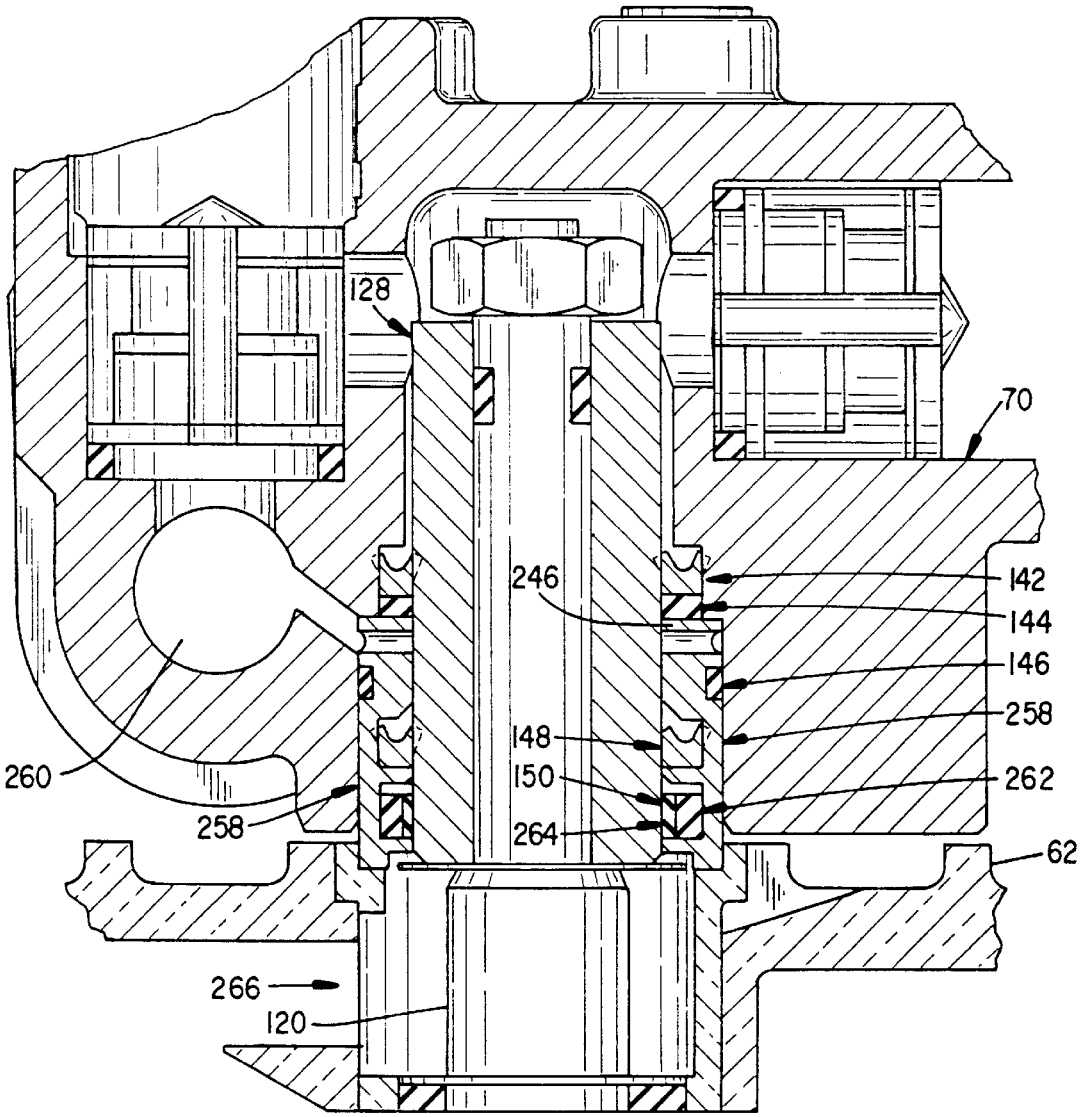
FIG. 11 is an enlarged partial sectional view illustrating the construction and placement of the improved seal cartridge 140 of the present invention.

Referring now to FIG. 11, shown is the improved seal cartridge assembly 116 of the present invention in use within the pump 60. The seal cartridge 140 is disposed within an aperture 258 formed in the head block 70 such that the upper groove 250 of the upper body portion 238 is generally aligned with an irrigation bore 260. The first and second high pressure seals 142, 144 reside directly above the upper lip member 246 of the seal cartridge 140. In a preferred embodiment, the first high pressure seal 142 is a standard U-cup which, when energized or expanded, envelopes the plunger 128 so as to form a fluid-tight junction therewith. The combination of the first and second high pressure seals 142, 144 are preferably capable of withstanding pressures of up to 3,000 to 4,000 p.s.i. so as to support a wide range of applications and operating pressures. The second high pressure seal 144 preferably comprises an anti-extrusion member which serves to prevent extrusion of the first high pressure seal 142 due to the pressure exerted downward from the head block 70 during operation. The first low pressure seal 148 is also a standard U-cup, however its main function is to provide a fluid-tight junction a predetermined distance below the first high pressure seal 142 so as to provide a bath of low pressure fluid against the first high pressure seal 142 for cooling purposes.

The second low pressure seal 150 preferably comprises a vacuum seal comprising an O-ring 262 disposed about a sealing cylinder 264. The O-ring 262 cooperates with the sealing cylinder 264 to bias the sealing cylinder 264 inward so as to prevent the passage of air from the drain area 266 to the fluid inlet or irrigation bore 260. In an important aspect of the present invention, the vacuum seal 150 establishes an air-tight junction with the plunger 128 so as to combat the influx of air during priming operations and periods of negative pressure conditions at the fluid inlet during normal operation. In an important aspect of the present invention, the improved seal cartridge assembly 116 is specifically designed such that a serviceperson need only remove the head block 70 in order to quickly and easily remove the cartridge member 140 for inspection and/or replacement of the first and second high pressure seals 142, 144, the first and second low pressure seals 148, 150, and the O-ring 146.

Figure 12A:
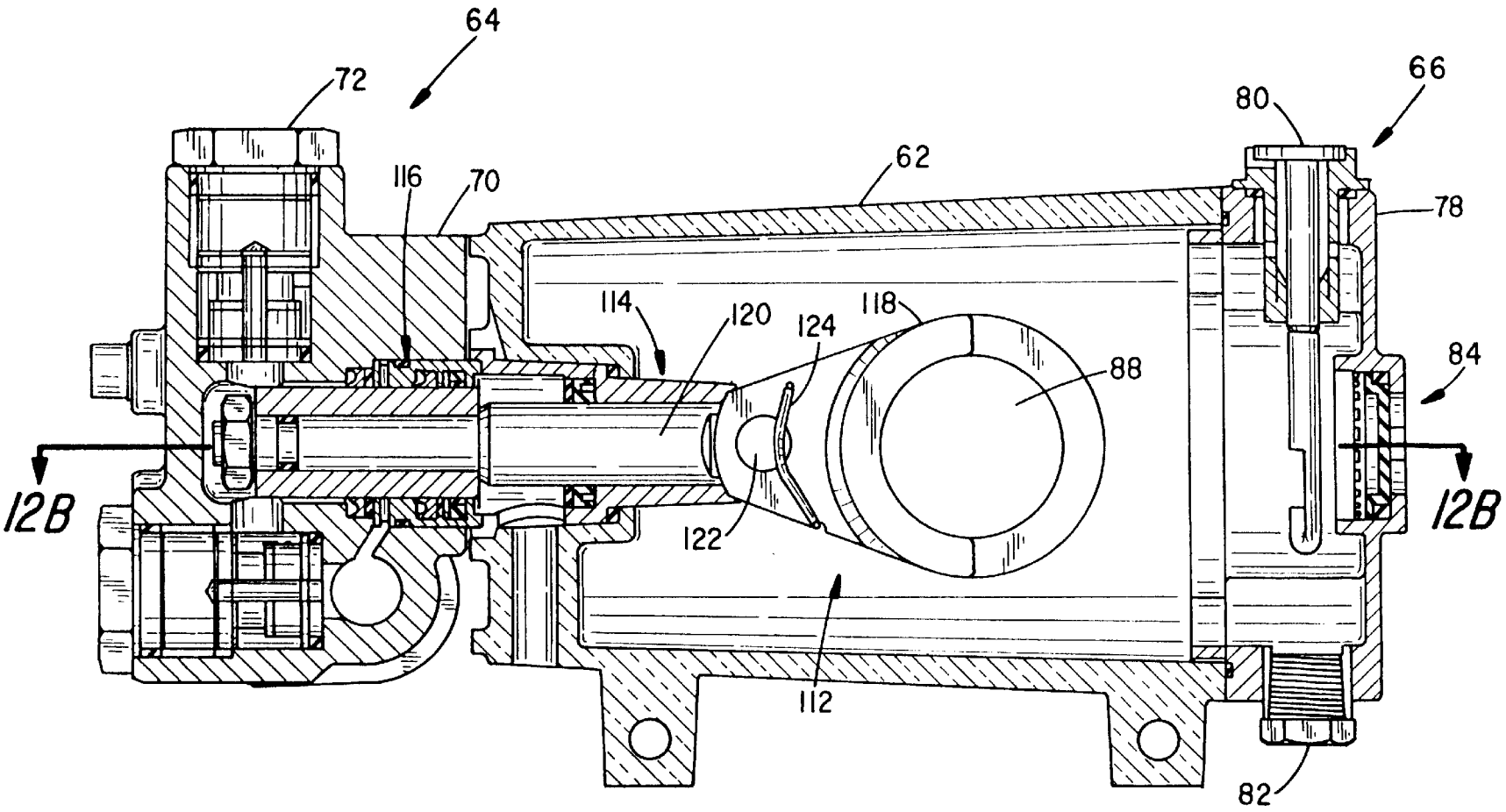
FIG. 12A is a partial sectional side profile of the plunger pump 60 shown in FIG. 1 during operation.
Figure 12B:
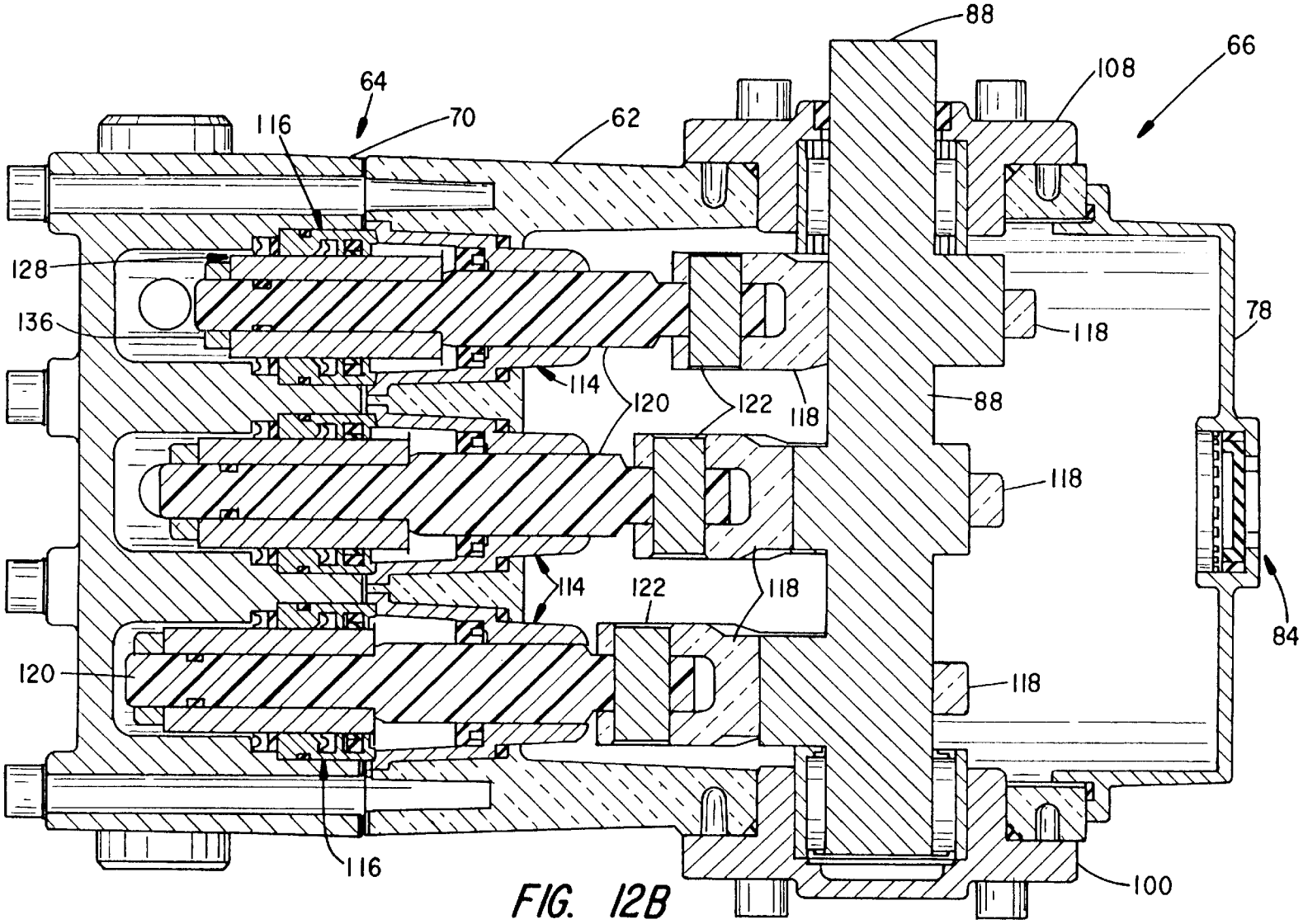
FIG. 12B is a partial sectional top view of the plunger pump 60 taken along lines 12B—12B in FIG. 12A.

FIGS. 12A and 12B are partial sectional views of the plunger pump 60 during operation to further illustrate the various inventive aspects of the present invention.

The preferred apparatus embodiments depicted herein are exemplary and numerous modifications, dimensional variations, and rearrangements can be readily envisioned to achieve an equivalent result, all of which are intended to be embraced within the scope of the present invention.

What is claimed is:

1. An improved plunger assembly for reciprocating pumps, comprising:

(a) plunger rod means having a first end, a second end disposed opposite said first end, and an aperture formed through said first end;

(b) connecting rod means for coupling said plunger rod means to a crankshaft to convert rotary motion of the crankshaft to linear reciprocating motion of the plunger rod means, said connecting rod means including a crankshaft aperture for receiving said crankshaft, and plunger rod receiving means having a bifurcated portion defining a pair of spaced buttresses for receiving said first end of said plunger rod means loosely therebetween; and (c) coupling means for coupling said plunger rod means within said plunger rod receiving means such that said plunger rod means is capable of translating in at least two directions between the pair of buttresses to automatically self-align during operation.

2. An improved seal carrying apparatus for use in reciprocating plunger pumps, comprising:

(a) seal cartridge means of unibody construction for placement within a bore formed in a crankcase, said seal cartridge means having a concentrically disposed aperture for receiving reciprocating plunger means, a first internally disposed receiving area adjacent to said aperture, a second internally disposed receiving area adjacent to said aperture, and first channel means formed along an exterior of said seal cartridge means;

(b) a first low pressure seal disposed within said first receiving area;

(c) a second low pressure seal disposed within said second receiving area, and (d) an O-ring disposed within said first channel means for sealing off fluid around the periphery of said seal cartridge means, whereby said seal cartridge means is capable of being quickly and easily removed from said bore to selectively replace one of said first low pressure seal, said second low pressure seal, and said O-ring.

3. An improved plunger pump, comprising:

(a) a crankcase having a guide cartridge bore formed therein and a crankshaft disposed therein;

(b) a plunger assembly including:

(1) plunger rod means having a first end, a second end disposed opposite said first end, and an aperture formed through said first end;

(2) connecting rod means for coupling said plunger rod means to a crankshaft to convert rotary motion of the crankshaft to linear reciprocating motion of the plunger rod means, said connecting rod means including said crankshaft aperture for receiving a crankshaft, and plunger rod receiving means having a bifurcated portion defining a pair of spaced buttresses for receiving said first end of said plunger rod means loosely therebetween; and (3) coupling means for coupling said plunger rod means within said plunger rod receiving means such that said plunger rod means is capable of translating in at least two directions between the pair of buttresses to automatically self-align during operation; and (c) selectively removable guide means having fluid seal means for the reciprocating plunger rod and a pair of guide members for guiding the plunger rod during reciprocation.

* * * * *